US008444789B2

(12) United States Patent
Guo

(10) Patent No.: US 8,444,789 B2
(45) Date of Patent: May 21, 2013

(54) DECORATIVE BRICK MOULD FOR IN-SITU PRODUCTION ON BUILDING

(75) Inventor: Silong Guo, Shanghai (CN)

(73) Assignee: Qiangte Energy-Saving Materials Co. Ltd., Shanghai (CN)

( * ) Notice: Subject to any disclaimer, the term of this patent is extended or adjusted under 35 U.S.C. 154(b) by 9 days.

(21) Appl. No.: 13/256,208

(22) PCT Filed: Apr. 24, 2009

(86) PCT No.: PCT/CN2009/071437

§ 371 (c)(1),
(2), (4) Date: Sep. 12, 2011

(87) PCT Pub. No.: WO2010/102463

PCT Pub. Date: Sep. 16, 2010

(65) Prior Publication Data

US 2012/0000593 A1 Jan. 5, 2012

(30) Foreign Application Priority Data

Mar. 12, 2009 (CN) ..... 2009 1 0047428

(51) Int. Cl.

| | |
|---|---|
| ***E04B 2/00*** | (2006.01) |
| ***E04B 1/16*** | (2006.01) |
| ***E04F 13/02*** | (2006.01) |
| ***B29C 39/12*** | (2006.01) |
| ***B29C 65/52*** | (2006.01) |
| ***B32B 37/00*** | (2006.01) |
| ***B32B 38/10*** | (2006.01) |
| ***B32B 43/00*** | (2006.01) |
| ***B28B 1/16*** | (2006.01) |
| ***B28B 7/10*** | (2006.01) |

(52) U.S. Cl.

USPC ..... 156/71; 156/247; 156/278; 156/279; 156/289; 264/35; 264/246; 264/256; 264/259; 264/334; 264/337; 264/338; 264/DIG. 31

(58) Field of Classification Search

USPC ..... 156/71, 247, 278, 279, 289; 264/35, 264/246, 256, 259, 316, 333, 334, 337, 338, 264/DIG. 31

See application file for complete search history.

(56) References Cited

U.S. PATENT DOCUMENTS 2,110,335 A 3/1938 Kritzer
2,549,017 A 4/1951 Saffir (Continued)

FOREIGN PATENT DOCUMENTS

CN 1046364 A 10/1990
CN 1054037 A 8/1991

(Continued)

OTHER PUBLICATIONS

International Search Report for PCT/CN2009/071437 dated Dec. 10, 2009.

(Continued)

*Primary Examiner* — Sing P Chan
(74) *Attorney, Agent, or Firm* — Levenfeld Pearlstein, LLC

(57) ABSTRACT

A decorative wall tile mold for the in-situ production on a building, wherein the mold, which can be demolded twice, is a sheet with pierced work, comprises the following detachable lateral structures: an insider layer: a bottom film is set at the bottom surface thereof, the bottom film and the building have a first combinative force; an outer layer: a surface film is set on the exterior surface thereof, a self-adhesive glue section is set up between the inside layer and the outer layer, which makes the outer layer and the inside layer have a second combinative force, and the second combinative force is less than the first combinative force. A method for the in-situ production of decorative patterns on a building is also provided.

6 Claims, 1 Drawing Sheet

U.S. PATENT DOCUMENTS

| | | | | |
|---|---|---|---|---|
| 2,595,142 | A * | 4/1952 | Herck | 264/31 |
| 2,964,800 | A * | 12/1960 | Dorsett | 264/112 |
| 3,438,795 | A | 4/1969 | Schroeder et al. | |
| 3,843,089 | A * | 10/1974 | Scholz et al. | 249/158 |
| 4,349,588 | A * | 9/1982 | Schiffer | 427/230 |
| 4,510,729 | A * | 4/1985 | Syring | 52/745.09 |
| 4,647,000 | A * | 3/1987 | Osada | 249/83 |
| 5,169,573 | A * | 12/1992 | Tsuchida et al. | 264/35 |
| 5,268,137 | A * | 12/1993 | Scott et al. | 264/225 |
| 5,460,087 | A | 10/1995 | Ogorzalek | |
| 5,502,941 | A * | 4/1996 | Zember et al. | 52/314 |
| 5,667,190 | A * | 9/1997 | Scott et al. | 249/16 |
| 5,685,523 | A * | 11/1997 | Sugiyama | 256/19 |
| 5,735,094 | A * | 4/1998 | Zember | 52/314 |
| 5,900,180 | A * | 5/1999 | Scott et al. | 249/61 |
| 5,922,235 | A * | 7/1999 | Scott et al. | 249/16 |
| 6,041,561 | A * | 3/2000 | LeBlang | 52/234 |
| 6,059,257 | A * | 5/2000 | Scott, III | 249/15 |
| 6,186,469 | B1 * | 2/2001 | Scott | 249/16 |
| 6,223,491 | B1 * | 5/2001 | Dial, Jr. | 52/439 |
| 6,237,294 | B1 | 5/2001 | Rygiel | |
| 6,240,691 | B1 * | 6/2001 | Holzkaemper et al. | 52/315 |
| 6,401,417 | B1 * | 6/2002 | Leblang | 52/481.1 |
| 6,413,336 | B1 * | 7/2002 | Likness | 156/71 |
| 6,500,543 | B2 * | 12/2002 | Sakai | 428/406 |
| 6,572,811 | B1 * | 6/2003 | Heirich | 264/426 |
| 7,238,406 | B2 * | 7/2007 | Peterson | 428/137 |
| 7,371,441 | B2 * | 5/2008 | Sakai et al. | 428/15 |
| 7,790,784 | B2 * | 9/2010 | Nasr et al. | 523/171 |
| 8,201,373 | B2 * | 6/2012 | Charles, Jr. | 52/314 |
| 2001/0021436 | A1 * | 9/2001 | Sakai | 428/150 |
| 2003/0066259 | A1 * | 4/2003 | Sudweeks | 52/506.05 |
| 2004/0157007 | A1 * | 8/2004 | Larocque | 428/15 |
| 2004/0261345 | A1 * | 12/2004 | McGrath | 52/506.01 |
| 2006/0180731 | A1 * | 8/2006 | Scott et al. | 249/15 |
| 2006/0197257 | A1 * | 9/2006 | Burt et al. | 264/255 |
| 2007/0227087 | A1 * | 10/2007 | Nasr et al. | 52/314 |
| 2009/0056257 | A1 * | 3/2009 | Mollinger et al. | 52/314 |
| 2009/0062413 | A1 * | 3/2009 | Adur et al. | 521/157 |
| 2010/0019123 | A1 * | 1/2010 | Scott | 249/13 |
| 2010/0219554 | A1 * | 9/2010 | Guo | 264/135 |
| 2010/0325993 | A1 * | 12/2010 | Bolin | 52/309.4 |
| 2011/0056165 | A1 * | 3/2011 | Charles, Jr. | 52/742.14 |
| 2011/0185662 | A1 * | 8/2011 | Mollinger et al. | 52/309.4 |

FOREIGN PATENT DOCUMENTS

| | | | |
|---|---|---|---|
| CN | 1060134 | A | 4/1992 |
| CN | 1128831 | A | 8/1996 |
| CN | 2291324 | | 9/1998 |
| CN | 1303456 | A | 7/2001 |
| CN | 1803475 | A | 7/2006 |
| CN | 101122165 | A | 2/2008 |
| CN | 101509314 | A | 8/2009 |
| GB | 2253878 | A | 9/1992 |
| JP | 3287901 | A | 12/1991 |

OTHER PUBLICATIONS

International Search Report issued in connection with PCT/CN2007/070546 on Mar. 13, 2008.

* cited by examiner

DECORATIVE BRICK MOULD FOR IN-SITU PRODUCTION ON BUILDING

CROSS-REFERENCE TO RELATED APPLICATION DATA

This is a National Stage Application of International Patent Application No. PCT/CN2009/000662, filed Apr. 24, 2009, which claims the benefit of and priority to Chinese Patent Application No. 200910047248.0, filed Mar. 12, 2009, the contents of each of which are incorporated fully by reference herein.

FIELD OF THE INVENTION

The invention relates to the field of building material construction, in particular to a decorative wall tile mould and the method for in-situ producing the decorative wall tile.

BACKGROUND OF THE INVENTION

Existing wall tiles of decoration on buildings are usually conducted through binding material to paste and to joint the wall tiles to the wall. The traditional tiling process has disadvantages as follows: (1) the finishing layer of wall tiles is heavy, about 4 pounds per square foot (lbs/sqft) (above 20 kg/m2); (2) execution of works (such as pasting process and joint pointing process etc.) is low efficiency (productivity of a common skilled worker per day is about 75-86 square feet or 7-8 m2); (3) the elastic modulus difference between the wall tiles and the binding materials will result in the security risks of the wall tiles dropping off and peeling off; (4) the appearance of the decorative cover of the wall tile will be affected by alkalization of the binding materials (generally cement mortar); (5) the jointing and construction factors will result in the leakage of the decorative layer; (6) because the patterns of the wall tile is not rich enough, complicated patterns of the wall tiles cannot be achieved; (7) the consumption of large amount of wall tiles will be contrary to energy conservation, environment protection and saving resources.

In order to overcome the problems mentioned above, the person skilled in the art has taken measures to improve the adhesive property of binding material, to enhance florescence resistance and waterproof-ness of the pointing material, as well as to use wall tile that is as light as possible (advising to be controlled below about 4 lbs/sqft or 20 kg/m2). Insufficiency of these measures is that, it makes more specific requirements for the property of the wall tiles, the binding materials, and the jointing materials, and it is difficult to control the construction process and the weight of the overall decorative layer cannot be greatly reduced. The risks of long term quality and safety are also present.

In order to overcome these problems, technical personnel have developed methods to be described as follows.

One approach is to make grooves at the back of the wall tile to increase the paste soundness thereof. However, this method still has the risk of peeling off, and the addition of a process will result in increased cost.

Another approach is to impress patterns into the primer coat using concavo-convex moulding boards. There are two ways to process the color of the formed surface, one is to color the pits with filling dope material after impressing, the other is to transfer impress by painting dope on the moulding board. The above two methods can not achieve the effect of uniform color. Either the color on the concave is not uniform, or the color on the convex is not uniform relative to both sides thereof due to uneven impressing. In addition, for the convenience of ejection from the mould, the mould is set up with an angle of about 5 degrees for ejection from the mould, from the front view, such as the irregular and non-uniform color in the pattern sides will seriously affect the color aesthetics and the regularity of color lumps.

Another approach is to impress the hollow moulding board carved with decorative design onto the wall, and knife the layer, which is similar to a screen painting process. Because the method takes place on the varnished wall, and the print process must be taken place when the wall is dry, there is a certain flatness error during processing the wall, that will cause gaps between the moulding and the wall when impressing and flattening the moulding board engraved with patterns onto the wall (in this case the wall is dry). When the layer is knifed, the decorating effect will be affected because of the leakage of concrete. In addition, it needs external force to fasten the moulding board during the continuous print of patterns. And there will definitely be errors in the splices of the moulding board and the formed patterns, which makes the operation more difficult.

Another way is to embed and to fasten the slabby mould with pierced works to a certain thickness into the primer coat before the initial set of the primer coat, then coat the surface thereof with dope, and further demoulding to get the patterns. The method faces problems during ejection from the mould course as follows. If the primer coat is wet, there exists texturing in the formed body after ejection from the mould, which affect the appearance seriously; if the primer coat is dry and the finishing coat is also dry, there exists cleaves and flashing in the formed body due to the demoulding clipping and the effect of friction; if the primer coat is dry and the topcoat is wet, there is no strength of structure in the topcoat, thus when stripping down the mould from the primer coat, the friction force between the topcoat and the mould will cause the primer coat with frictional flashing to break away with the topcoat, which will affect the formed body. And because the topcoat is an aggregate coat, the execution of works will be limited to the brush coating and spray finishing, and color shift will be generated due to the junction of the two working surfaces and the texture difference of the decorative surface, thus the method cannot get the decorative effect of uniform color and regular patterns.

In sum, there is a lack of wall tile which can be produced in-situ and of uniform color lumps and regular forming surface and the method thereof.

SUMMARY OF THE INVENTION

The purpose of the present invention is to provide a decorative wall tile mould which can produce in-situ wall tiles, which wall tiles are of uniform color and regular forming surface.

The second aim of the present invention is to provide an in-situ method that can produce wall tile which can be produced in-situ and of uniform color and regular forming surface on the building.

In the first aspect, this invention is to provide a wall tile mould which can be used for in-situ production of wall tile on a building, wherein the mould, which can be demoulded twice, is a sheet with apertures or openings that comprises the detachable lateral structures as follows:

an inside layer mould structure; a bottom film is set at the bottom surface thereof, between the bottom film and the building there is a first combinative force;

an outer layer mould structure: a surface film is set at the exterior surface thereof;

A self-adhesive glue section is set up between the inside layer and the outer layer, which makes a second combinative force between the outer layer and the inside layer; and the second combinative force is less than the first combinative force.

In the second aspect, this invention is to provide a method for in-situ production of decorative wall tile on a building, comprising steps as follows:

coating the surface of the building with a primer coat;

and embedding and impressing the dedicated slabby decorative wall tile mould with apertures or openings, which can be demoulded twice, into the primer coat before loses of plasticity, so as to get the first compound body and to flatten the first compound body; the slabby decorative wall tile mould with apertures or openings, which can be demoulded twice, comprises an outer layer and an inside layer;

After curing the compound body, coating with an intermediate-coat on it;

before the intermediate-coat loses of plasticity, striping down the first layer of the decorative wall tile mould and curing thereafter; and thus getting the second compound body;

coating on the second compound body with the topcoat; striping down the second structure of decorative wall tile, which can be demoulded twice, to get the said decorative wall tile for in-situ production.

BRIEF DESCRIPTION OF THE DRAWINGS

FIG. 1-*a* is a front view of the mould of the decorative wall tile which can be demoulded twice;

FIG. 1-*b* is a diagrammatic side view of the decorative wall tile mould, which can be demoulded twice.

FIG. 2-*a* is a front view of the decorative wall tile mould with pierced work, which can be demoulded twice, overlaid on the wall of a building;

FIG. 2-*b* is the view of the lateral structure of the first compound body;

FIG. 2-*c* is a view of the lateral structure of the second compound body;

FIG. 2-*d* is a view of the lateral structure of the second compound body coated with the topcoat;

FIG. 2-*e* is a view of the lateral structure of the decorative wall tile produced.

DETAILED DESCRIPTION OF THE INVENTION

Figure 1:
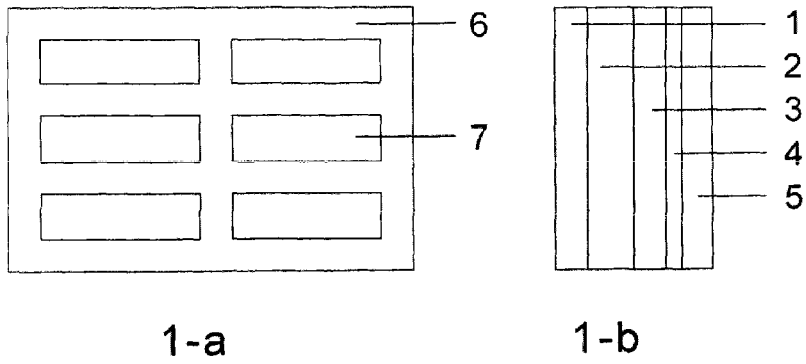
FIG. 1 is a view of an embodiment of the mould according to the present invention.

The present invention is to further improve the monolayer slabby mould with apertures or openings. Inventors found that the wall tiles in the current system, when the monolayer slabby mould with apertures or openings is used for in-situ production of wall tile, although it is convenient for in-situ production of wall tile, it needs further improvement to obtain decorating effect of uniform color and regular pattern. Specifically, the monolayer slabby mould with apertures or openings faces problems and can be improved as follows: there exists problems in the process of ejection from the mould, for instance, when the wet primer coat is used, the appearance will be affected by the texturing in the forming surface; if the ejection from the mould occurs when the primary coat and the topcoat are both dry, the forming surface will be with cleaving and edge chipping, because of demoulding cutting and the effect of friction; when the wet primary coat with the wet topcoat is used, the structural strength of the topcoat is not formed at this time, when the mould embedded in the primary coat is demoulded, the friction force between the topcoat and the mould will make the primary coat with flashing demoulded with the topcoat, which will greatly affect the forming surface. In addition, as the aggregate coat is used as topcoat, the execution of works can only be trowelling and spraying finishing, color shift will take place due to the splices of the working faces and texture difference of decorative surfaces, so the method will have a chance to have flashing problems. Therefore, it needs to be post-monitored and rework on the flashing area monitored.

With regards to this, the inventors have created a preparing method for in-situ production of decorative wall tile and the dedicated mould thereof through extensive research and by improving the mould and the preparation process. Specifically, the surface of the building is coated with a primer coat; and the dedicated slabby decorative wall tile mould with apertures or openings, which can be demoulded twice, is embedded into the primer coat before its lose of plasticity, to get the compound body of the primer coat with decorative wall tiles. Coating the compound body after curing with an intermediate-coat, and before the intermediate-coat loses plasticity, striping down the first layer of the decorative wall tile mould and curing thereof, coating the compound body of the intermediate-coat and the primer coat after curing and the decorative wall tile mould (with the second mould structure left) with a topcoat; striping down the second structure of decorative wall tile to achieve the decorative wall tile for in-situ production. The mould and method in the present invention can prepare the wall tiles with forming surface without flashing and edge chipping, which is of uniform color and regular pattern, and is convenient for the color register thereof.

As used in this article, the said "lose of plasticity" refers to the material constituting the coat loses of mobility. Specifically, when the said "the material constituting the coat" is cement, said "loses of plasticity" refers to cement loses of mobility after initial set. When the said "the material constituting the coat" is other coats, it refers to the other coat becoming congealed and losing mobility. The standard of initial set of the cement can be set according to the national standard, occupation standard or manufacture's manual. The said other coats congealed standard can be set according to the relevant national standard, industry standard or manufacture's manual.

As used in this article, the said "the surface of a building", unless otherwise specified, refers to the metope, superface of a building, such as the external wall, the interior wall and the ceiling. The said metope can be a thermal insulation wall, or an ordinary wall.

As used in this article, the said "slabby mould with apertures or openings", unless otherwise specified, refers to the slabby mould with pierced works (such as piercing holes, apertures or openings) in the right side, the pierced patterns constitute the shape of a decorative wall tile. The said "the right side" refers to the front view of the metope.

As used in the article, the said "slabby mould with apertures or openings, which can be demoulded twice", unless otherwise specified, refers to a mould with apertures or openings in the right side, and with an outer layer and an inside layer in the lateral side, that is, said mould having structures which can be demoulded twice. For example, the outer layer and the inside layer are glued by non-setting adhesive with adhesive force less than 600 g/m$^2$.

As used in this article, the said "primer coat", unless otherwise specified, refers to one or more layers (the coat is for example, mortar) directly contacted with the surface of a building. For one or more layers, each can be formed by coating one or more times.

As used in this article, the said "intermediate-coat", unless otherwise specified, refers to one or more layers directly contacted with the first compound body. For one or more layers, each can be formed by coating one or more times.

As used in this article, the said "the first compound body", refers to the combination of primer coat and the slabby mould with apertures or openings, which can be demoulded twice, which is obtained by embedding and impressing the dedicated slabby decorative wall tile mould with apertures or openings, which can be demoulded twice, into the primer coat before is has lost plasticity. Usually the surface of the slabby mould with apertures or openings, which can be demoulded twice, forms a concave or convex relative to the primer coat. Therefore, screeding the first compound body is needed for the utilization in the subsequent steps. There is no limit to "screeding", as long as by which the purposes of present invention are not limited. To the skilled person in the art, the "screeding" step is known.

As used in this article, the said "topcoat", unless otherwise specified, refers to one or more layers directly contacted with the second compound body. For one or more layers, each can be formed by coating one or more times.

The said "second compound body" is the combination of the intermediate-coat and the first compound body with the outer layer striped down, which can be got by the method as follows: coating the compound body after curing with an intermediate-coat, striping down the outer layer from the slabby mould with apertures or openings, which can be demoulded twice, before the intermediate-coat loses of plasticity and curing thereof, to get the second compound body. There is no limit to "curing", which can be set according to national standard, industry standard or manufacturer's manual.

All aspects of the invention will be described further in the following.

Decorative Wall Tile Mould

The inventors invent a slabby mould with apertures or openings, which can be demoulded twice through extensive experimental research, which is convenient for in-situ production of decorative wall tile, and overcomes the flashing phenomenon therein, improves working efficiency, and can produce wall tiles which are more neat and artistic, and of low rework rates.

To this end, the invention provides a decorative wall tile mould for in-situ production used for buildings, wherein the mould with apertures or openings, which can be demoulded twice, comprises detachable lateral structures as follows:

an inside layer mold structure; a bottom film is set at the bottom surface thereof, the bottom film and the building have a first combinative force;

an outer layer structure, a surface film is set at the exterior surface thereof;

a self-adhesive glue section is set up between the inside layer and the outer layer, which makes a second combinative force consist between the outer layer and the inside layer, and the second combinative force is less than the first combinative force.

The thickness of the decorative wall tile mould in the present invention can be set according to the needs of the construction, which is typically less than that of the primer coat, specifically, for example, between 0.3 mm and 3 mm, preferably 1±0.5 mm.

The patterns in the decorative wall tile mould in the invention can be of any design, which is designed through the shape in the right side of the mould with apertures or openings. There is no limit to the patterns in the decorative wall tile mould in the invention, which depends on the shape of the decorative wall tile, such as the shape of brick, the shape of pebble, geometric graphics, flower graphics and so on, as long as by which the purposes of the present invention are not limited.

A bottom film is set up on the bottom surface thereof. Preferably, the bottom film is a smooth surface, which can make the bottom film readily fixed on the surface of the building by the prime coat, the advantage thereof is in that: when the mould is coated onto the wet primer coat, the smooth back will absorb and cling to the primer coat. More preferably, the inside layer is made of material which is smooth before coated, and is flexural and deformable when being demoulded (cut and stripped). There is no limit to the extent to the flexural and deformation, as long as the resistance of ejection from the mould decreases, such as laminating sheet, plastic or the combination thereof. Other materials can also be used, as long as the bottom film and the building can have a first combinative force by the primer coat, and the first combinative force is less than the combinative force of the self-adhesive glue section. When used, there is absorbability between the bottom film and the primer coat, and when the strength of the primer coat is enhanced, the adhesive force there is increased.

Specifically, when the inside layer is a commercially available tectorial membrane sheet, the bottom film refers to the film nearing the building; when the inside layer is a single plastic, the bottom film refers to the basal surface of the plastic nearing the building. The inventor found that the tectorial membrane sheet commercially available can achieve the same ejection effect from the mould as the plastic, and is smooth before coated, and of low cost, with the environmental protection not affected.

Preferably, the surface film of the outer layer is a smooth surface. In a preferred embodiment of the present invention, the front smooth surface will make the coating of the topcoat more smooth. There is no limit to the combinative force of the surface film, as long as by which the purposes of the present invention are not limited.

Preferably, the self-adhesive glue section is a self-adhesive layer with glue spread less than 600 g/m$^2$ (glue spread ranging from 250 to 600 g/m$^2$ is Preferable), which makes the film connected with the sheet not broken down. The non-setting adhesive is preferably acrylic adhesive. The volume of glue spread mentioned above will make the ejection process from the mould more smooth.

The advantages of the decorative wall tile mould which can be demoulded twice, are in that: when coating the mould onto the primer coat, the smooth surface will cling to the primer coat; when the strength of the primer coat after curing is enhanced, the combinative force between the primer coat and the back of the mould will enhance simultaneously, it is larger than the combinative force between the front two layers laminating, which are attached by the volume of glue spread less than 600 g/m$^2$, and that makes the ejection of the outermost layer from the mould convenient and fast.

The Intermediate-Coat and the Primer Coat

There is no limit to the ingredient of the intermediate-coat and that of the primer coat, as long as by which the purposes of the present invention are not limited. For example, the traditional formula can be used, specifically, for example, the primer coat/the intermediate coat comprises a material selected from the group consisting of gel materials, filler materials, pigment, optional additives and optional aggregate; the said gel material can be inorganic gel materials, organic gel materials or the combination thereof.

There is no limit to the inorganic gel material, such as cement, gypsum, lime, sodium silicate and so on, as long as by which the purposes of the present invention are not limited. There is no limit to the dosage of the inorganic gel material, as long as by which the purposes of the present invention are not limited.

There is no special limit to the organic gel material, as long as by which the purposes of the present invention are not limited.

There is no special limit to the filler materials, as long as by which the purposes of the present invention are not limited. The materials common in this field can be used, such as stone dust, fiber and so on. There is no limit to the dosage of the filler materials, as long as by which the purposes of the present invention are not limited.

There is no special limit to the additives, as long as by which the purposes of the present invention are not limited. The additives common in this field can be used, such as polymer powder, pigments, cellulose ether and so on. There is no limit to the dosage of the additives, as long as by which the purposes of the present invention are not limited.

There is no special limit to the aggregate, as long as by which the purposes of the present invention are not limited. Coarse aggregate, fine aggregate or combinations thereof can be used, for example, the coarse aggregate commonly used in the field such as quartz stone, granite, andesite and so on. The fine aggregate commonly used in the field such as quartz sand, natural river sand and so on. When the combination of coarse aggregate and fine aggregate is used, there is no limit to the combining proportion, as long as by which the purposes of the present invention are not limited.

Other substances can also be added to the intermediate-coat and the primer coat, for example, filler material. Specifically, as a pre-shaped fiber structure, such as mesh may be added. There is no special limit to the fibrous material, as long as to which the purpose of the present invention not bounded.

To make the decorative wall tile mould embedded into the primer coat, the thickness of the primer coat is usually greater than that of the decorative wall tile mould, more preferably, the thickness of the primer coat is of 1-4 mm greater than that of the decorative wall tile mould.

The Topcoat

The ingredient of the topcoat comprises a material selected from the group consisting of gel material, filler material, pigment, optional additives except aggregate; said gel material can be inorganic gel material, organic gel material or the combination thereof. The meanings of "the inorganic gel material", "organic gel material", "filler", "pigment", "additive" are the same as the terms used in the primer coat, and the ingredients of each layer can be the same or not.

Other substances can also be added to the topcoat, such as filler material which can produce a variety of surface properties and physical and chemical properties, there is no limit to the filler material, as long as by which the purposes of the present invention are not limited. Such as luminous powder, metal particles, shell particles and so on are preferred.

An In-Situ Production Method of Decorative Wall Tile

An in-situ production method of decorative wall tile in the present invention comprises the steps as follows:

coating the surface of the building with a primer coat; embedding the dedicated slabby decorative wall tile mould with apertures or openings, which can be demoulded twice, into the primer coat before loss of plasticity, to get the first compound body of primer coat and flatten the first compound body; the slabby decorative wall tile mould with apertures or openings, which can be demoulded twice, comprises an outer layer and an inside layer;

and coating the first compound body after curing with an intermediate-coat, striping down the outer layer of the decorative wall tile mould before the intermediate-coat loss of plasticity and curing thereof, getting the second compound body;

coating the second compound body with a topcoat;

striping down the inside layer of said decorative wall tile mould to get the decorative wall tile for in-situ production.

The in-situ production method of decorative wall tile in the present invention can be used for various building surfaces, such as, common wall, insulated wall, ceiling and so on. There are many manufacture methods used for insulated wall with no constriction. For example, glue polystyrene foam board to the outer wall by glue, and then coat the polystyrene foam board with the primer coat comprising mesh, the foam board can also be fastened by anchor bolts; or put the insulation coating (For example, polystyrene particles) on the outer walls.

There is no special limitation to the time of "before the primer coat of the invention loss of plasticity", as long as the layer still has plasticity. For example, within 30 minutes after the layer is coated. Typically, the impressing step of wall tiles is carried out prior to the loss of plasticity. Specifically, for example, within 30 minutes after the primer coat is coated.

There is no special construction to the coat of the decorative wall tiles in the present invention, as long as by which the purpose of the present invention are not limited. Usually spatula, roller are used to embed the mould into the primer coat. Preferably, the barbed roller is used to embed the mould into the primer coat.

There is no special restriction to the curing time of the compound body of the primer coat and the slabby decorative wall tile mould with apertures or openings, which can be demoulded twice, as long as the primer coat and the slabby decorative wall tile mould with apertures or openings, which can be demoulded twice, can be solidly fastened together. Preferably, the curing time of the compound body of the primer coat and the slabby decorative wall tile mould with apertures or openings, which can be demoulded twice, can be adjusted according to weather conditions, more preferably, it can be adjusted to above 12 hours after the decorative wall tile mould is embedded.

The applicants concluded through experiments that, the curing time of the compound body of the primer coat and the slabby decorative wall tile mould with apertures or openings, which can be demoulded twice, varies with the weather, for example, when the temperature is of 5° C., the curing time is 12 hours; the higher the temperature, the shorter the curing time.

The applicants concluded through experiments that, when embedding the decorative wall tiles mould which can be demoulded twice into the primer coat before loss of plasticity (such as initial set of cement), the combinative force is enhanced with the intensity of the primer coat, which increases after curing. In a preferred embodiment of the present invention, fasten the decorative wall tiles mould which can be demoulded twice to the primer coat for a year for outdoor test when the temperature is above 5° C., there is no phenomenon of the mould peeling off from the primer coat.

There is no special restriction to the time "before the intermediate-coat loss of plasticity". Preferably, the time before the intermediate-coat loss of plasticity can be adjusted according to construction requirements, more preferably, for example, adjusted to be within 30 minutes after the intermediate-coat coated.

Preferably strip down the outer layer of the decorative wall tiles mould which can be demoulded twice before the intermediate-coat loss of plasticity, strip down the outer layer of the decorative wall tiles mould which can be demoulded twice within 30 minutes after the intermediate-coat coated.

There is no special limitation to the curing time of the intermediate-coat, as long as the strength of structure of the intermediate-coat, the combinative force between intermediate-coat and the primer coat are strong enough to resist the friction force of ejection from the mould. Preferably, the curing time of the intermediate-coat can be adjusted according to weather conditions, more preferably, adjusted to 24 hours after the intermediate-coat coated.

There is no special time limit to stripping down the remaining layer (that is the inside layer of the decorative wall tiles mould which can be demoulded twice) of the decorative wall tiles mould which can be demoulded twice. The step can occur immediately after the topcoat coated or after curing the topcoat for a period of time. Preferably, stripping down the remaining layer of the decorative wall tiles mould which can be demoulded twice occurs after curing the topcoat for a period of time. More preferably, 24 hours later after curing the topcoat.

There is no special limit to the coating method of each layer, as long as by which the purpose of the present invention are not limited. such as the method of spray finishing, knife coating, roller coating and so on, preferably, the methods of spray finishing, knife coating are used for the primer coat and the intermediate-coat, while the methods of the spray finishing, knife coating, and the brush coating for the topcoat.

The primer coating and/or the intermediate-coat and/or the topcoat can be coated one or more times. Preferably, the primer coating and/or the intermediate-coat and/or the topcoat can be coated several times of coating mentioned includes twice or more of coating. The applicants found that by several times (two or more times) of coating, the color shift between finishing layers could be eliminated.

There is no special limit to the bonding force of the topcoat, as long as the binding force between the intermediate-coat and the topcoat and that between the topcoat and the primer coat, are less than that between the intermediate-coat and the primer coat. Preferably, the content of the glue material in the topcoat and that of the additive dedicated to the bonding force are less than that of the primer coat and the intermediate coat.

One or more layers can be coated on the decorative wall tile for in-situ production. There is no special limit to the class and the layer number of the outer layer, as long as by which the purposes of the present invention are not limited, which can be the same as the primer coat and/or the intermediate-coat and/or the topcoat or not, for special example, the layer can be transparent or opaque.

Other processes can be included in the in-situ production method of decorative wall tile, as long as by which the purposes of the present invention are not limited, for example, knife the metope before coating the primer coat; or another example is to do finishing work on the intermediate-coat and/or topcoat, specifically to form the finishing surface of mill finish, matte side or demi-matte side.

Preferred embodiments are provided by the applicant as follows:

Specific methods and time of ejection from the mould can be used for the ejection from the mould of the slabby decorative wall tile mould with apertures or openings, which can be demoulded twice, comprising an outer layer and an inside layer. Specifically, strip down the outer layer before the intermediate-coat loss of plasticity, and strip down the inside layer (the remaining part of the mould) after the topcoat has been coated. The applicants found that the ejection method from the mould above can obtain decorative wall tile for in-situ production of uniform color, neat, no flashing, and easy for color register.

The applicants found that, after a period of time (e.g. 12 h, depending on the weather condition) of curing the compound body of the primer coat and the decorative wall tile mould which can be demoulded twice, coating the intermediate-coat and striping down the outer layer of the decorative wall tile mould which can be demoulded twice before the initial set of the intermediate-coat, the remaining layer of the decorative wall tile mould which can be demoulded twice will not be taken out of the primer coat. While striping down the outer layer of the decorative wall tile mould which can be demoulded twice before the initial set of the intermediate-coat, there will be no edge chipping and flashing in the forming surface. When after 24 hours of curing to a certain structural strength of the intermediate-coat, the binding force between the intermediate-coat and the primer coat is enhanced. After the topcoat is coated, striping down the remaining layer of the decorative wall tile mould which can be demoulded twice from the primer coat. The intermediate-coat with strength of structure can afford to the damage of friction from the remaining layer of the decorative wall tile mould which can be demoulded twice. The binding force between the intermediate-coat and the primer coat after curing is strong, and the peeling off of the intermediate-coat and the primer coat will not happen due to the friction during the second time of ejection from the mould. As there is no ingredient of aggregate in the topcoat bundled in the intermediate-coat with strength of structure and part of the primer coat, it only has thickness of about 0.1 mm, meanwhile adjusting the binding force of the topcoat to make the binding force between the topcoat and the intermediate-coat and that between the topcoat and the primer coat are both less than that between the intermediate coat and the primer coat, when stripping down the remaining layer of the mould, a small part of the topcoat coated on the remaining layer of the mould and the lateral of the intermediate-coat with strength of structure will be taken out because of the rubbing effect of the ejection from the mould, as there is no ingredient of aggregate in the topcoat, the fracture surface of the topcoat produced by the ejection from the mould and shearing action is very smooth.

The advantages of the present invention are:

(1) The ceramic wall tile per square meter have a self-weight of 15-20 kg, in the existing paving way of wall tile, while there is no use of wall tile in the present invention, so the self-weight of 15-20 kg/m$^2$ of the decorative wall tile system can be reduced by the method in the present invention.

(2) It is accurate, reliable and convenient to embedding the decorative wall tile mould which can be demoulded twice into the primer coat before the initial set of the primer coat; after the curing of the primer coat, the binding force and the mechanical occluding force and the adsorption force between the back and the lateral of the mould and the primer coat are greater than the binding force of the non-setting glue between the two layers of the decorative wall tile mould which can be demoulded twice, it is fluent to strip down the outer layer on the front before the initial set of the intermediate-coat, and the remaining part of the mould will not be taken out, the forming surface of the intermediate-coat of the decorative wall tile is regular and without flashing and edge chipping.

(3) The curing processes to the primer coat and the intermediate-coat in the present invention, make the strength of structure of the primer coat and the intermediate-coat enhanced, and the binding force between the primer coat and the intermediate-coat augmented at the same time, when stripping down the remaining part of the mould at this time, the moulded intermediate-coat will not be damaged.

(4) As the binding force between the intermediate-coat and the topcoat and that between the topcoat and the primer coat, are less than that between the intermediate-coat and the primer coat, and there is no ingredient of aggregate in the topcoat, the final formed surface of the decorative wall tile mould which can be demoulded twice is regular and of no flashing and edge chipping.

(5) The decorative wall tile mould which can be demoulded twice in the present invention, the remaining part of the mould with the front outer layer stripped down makes it possible for the coating of uniform topcoat on the intermediate-coat, and the topcoat will not go into the front of the primer coat. Meanwhile the remaining part of the mould will make it convenient for the coating of the topcoat of different color on the intermediate coat. The decorative wall tile of uniform colors, and which can be color processed can be obtained by the method in the present invention.

(6) In the present invention, a variety of decorative pattern can be obtained by patterns of the decorative wall tile mould, to produce decorative wall tiles with a variety of sights. The system can be widely used in the field of indoor and outdoor wall decoration, and a wealth of decorating effect can also be produced combined with dope (such as metallic paint, etc.) used in the surface coating.

The invention will be further described combined with the specific embodiments as follows. It should be appreciated that these embodiments are used for illustration only not to limit the scope of the present invention. The specific conditions of the experimental method which are not indicated are usually in accordance with normal conditions or with the conditions recommended by the manufacturer.

Unless otherwise defined or described, all professional and scientific terms used in the article are of the same meanings as that familiar to the skilled in the field. In addition, any methods and materials similar to that recorded in the article are also included in the method in the present invention.

EXAMPLES

FIG. 1-*a* is a front view of the decorative wall tile mould which can be demoulded twice, FIG. 1-*b* is a side view of the decorative wall tile mould which can be demoulded twice.

As shown in FIG. 1-*a*, the decorative wall tile mould which can be demoulded twice is a slabby pierced (or apertured) structure, the body of the mould 6 has pierced brick holes 7. The thickness of the body of the mould 6 is the sum of the thickness of each layer shown on FIG. 1-*b*, which is of about 0.6 mm.

As shown in FIG. 1-*b*, wherein: the inside layer is a double tectorial membranes sheet (Commercially available) comprising a bottom tectorial membrane 1, a sheet 2 and an insulation tectorial membrane 3, wherein the bottom tectorial membrane 1 is a transparent tectorial membrane set on the back of the double tectorial membranes sheet, which has a thickness of about 0.05 mm; the sheet 2 is an intermediate layer of the double tectorial membranes sheet, which has a thickness of about 0.4 mm; the insulation tectorial membrane 3 is a transparent tectorial membrane set on the front of the double tectorial membranes sheet, which has a thickness of about 0.05 mm;

In the self-adhesive glue section 4, the glue spread there is not more than 600 g/m$^2$;

The outer layer is a surface tectorial membrane 5, which has colored tectorial membrane on the front (which is made of the same material as the bottom tectorial membrane 1), the thickness of which is about 0.1 mm or so, and the colored tectorial membrane can be used to easily distinguish the front from the back of the mould. The said bottom tectorial membrane 1, the sheet 2 and the insulation tectorial membrane 3 can be coated one another by currently existing tectorial membrane processes.

In other embodiments, said inside layer can be a one-layer plastic, said one-layer plastic can be a substitution of the bottom tectorial membrane 1, the sheet 2 and the insulation tectorial membrane 3.

Figure 2:
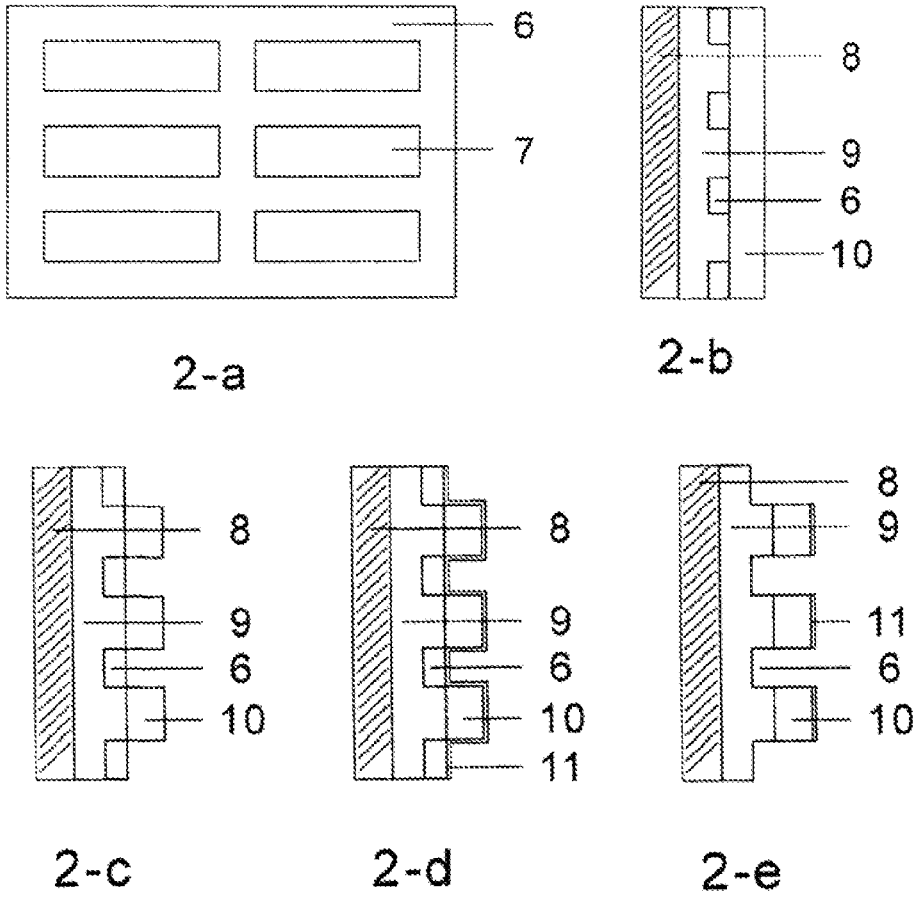
FIG. 2 is the view of an embodiment of the in-situ production method of wall tile according to the present invention.

FIG. 2-*a* is a front view of the decorative wall tile mould which can be demoulded twice is coated on the metope of a building, FIG. 2-*b* is a view that coating the intermediate-coat on the flat surface after curing of the compound body of the primer coat and the mould, that is a view of the lateral construction of the compound body.

In the FIG. 2-*b*, coat the wall 8 with the primer coat 9, the coating rate is of about 2-2.5 kg/m$^2$. Before the initial set of the primer coat 9, embedding the body of the decorative wall tile mould 6 into the primer coat 9 by barbed roller, flatten the compound body of the primer coat 9 and the decorative wall tile mould 6 using the spatula, after 12 hours of curing, coat an intermediate-coat 10 on the compound body of the primer coat 9 and the decorative wall tile mould 6, the coating rate of the intermediate-coat 10 is of 1.6-2.0 kg/m$^2$. Before the initial set of the intermediate-coat 10, strip down the colored tectorial membrane in the front of the decorative wall tile mould 6, to get the lateral construction of the second compound body shown in FIG. 2-*c*, the non-setting adhesive glue section 4 is stripped down with the surface colored tectorial membrane 5. after the surface colored tectorial membrane 5 and the self-adhesive glue section 4 stripped down from the decorative wall tile mould 6, Now the remaining part of the decorative wall tile mould comprises the bottom tectorial membrane 1, the sheet 2 and the insulation tectorial membrane 3. after 24 hours of curing of the intermediate-coat 10, roll coating the topcoat 11 without aggregate on the surface of the structure shown in FIG. 2-*c* to get the structure shown in FIG. 2-*d*, the coating rate of the topcoat 11 without aggregate is of about 0.3 kg/m$^2$. after 24 hours of curing of the topcoat, strip down the remaining part of the decorative wall tile mould 6, that is the bottom tectorial membrane 1, the sheet 2 and the insulation tectorial membrane 3 of the structural layers of the decorative wall tile mould to get the structure shown in FIG. 2-*e*. As shown in FIG. 2-*e*, after two times of ejection from the mould, there are the color of the remaining primer coat 9 which is the brickwork joint's color and the combination of the entire intermediate-coat 10 and the topcoat 11 of the decorative wall tile remained in the decorative wall tile mould 6. the color of the brick decorative cover obtained by the method of coating the topcoat 11 without aggregate is more uniform comparing to that coating the intermediate-coat 10. In other embodiments, superface treatment can be done to the finished surface of the intermediate-coat 10 and/or topcoat 11 according to the design requirements, such as roughening, embossing rolls and so on. Other aspects in the present invention are obvious to the skilled in the art due to the disclosure of the article.

In other embodiments, various layers can be coated in the intact decorative cover as required.

The advantage of the embodiment above is in that: when embed the decorative wall tile mould which can be demoulded twice into the primer coat and cure of the primer coat to a certain of strength of structure, there is a great bonding force between the smooth tectorial membrane on the back of the decorative wall tile mould which can be demoulded twice, which is greater than that between the two layers of smooth tectorial membranes on the front of the decorative wall tile mould which can be demoulded twice. At this moment, before the initial set of the intermediate-coat 10, strip down the outmost layer (broken down at the joint of the non-setting glue) on the front of the decorative wall tile mould, by which the remaining part on front of the decorative wall tile mould will not be taken out, the ejection resistance from the mould is small before the initial set of the intermediate-coat.

EXAMPLES OF PERFORMANCE

1.1 The Experiment of Ejection from the Mould

Experimental conditions;

(1) the primer coat: cement, the filling material is sand with the fitness of 70-140 mesh, the dosage of which is 2 kg/m$^2$ (2) the intermediate-coat: cement, the filling material is sand with the fitness of 40-70 mesh, the dosage of which is 2 kg/m$^2$ (3) the topcoat: concrete, 0.3 kg/m$^2$ (4) air temperature: 10° C.

Make the appearance test with reference to allowed band (GB/T4100-92) of the presentation quality of the glazed interior wall tile Test the time of initial set of the intermediate-coat and the topcoat with reference to the GB/T1346-2001《Test methods for water requirement of normal consistency, setting time and soundness of the portland cements》.

1.1.1 The Dejection Time from the Mould of the First Compound Body

| | The result of the appearance test | 10 min | 20 min | 30 min | 45 min | 50 min | 60 min |
|---|---|---|---|---|---|---|---|
| The formed body of the first compound body FIG. 2b | Edge chipping | no | no | no | no | little | much |
| | Flashing | no | no | no | no | little | much |

1.1.2 The Natural Curing Time of the First Compound Body

| the curing time of the first compound body | The appearance of the first compound body after demoulded |
|---|---|
| 2 h | edge chipping Seriously |
| 4 h | edge chipping Seriously |
| 6 h | edge chipping Seriously |
| 8 h | edge chipping Seriously |
| 10 h | edge chipping Seriously |
| 12 h | little of edge chipping |
| 14 h | little of edge chipping |
| 16 h | little of edge chipping |
| 18 h | little of edge chipping |
| 20 h | little of edge chipping |
| 22 h | little of edge chipping |
| 24 h | no edge chipping |
| 2 d | no edge chipping |
| 7 d | no edge chipping |

1.1.3 The Curing Time of the Primer Coat

| The curing time | The planeness of the appearance of the primer coat after demoulded |
|---|---|
| 10 min | There is texturing existed, and the surface is not smooth |
| 20 min | the surface is not smooth with much rough spots |
| 30 min | the surface is not smooth with much rough spots |
| 40 min | the surface is not smooth with much rough spots |
| 1 h | the surface is not smooth with little rough spots |
| 5 h | the surface is not smooth with little rough spots |
| 9 h | the surface is not smooth with little rough spots |
| 12 h | the surface is smooth without rough spots |
| 1 d | the surface is smooth without rough spots |
| 7 d | the surface is smooth without rough spots |

1.2 The Binding Force

Experimental condition: 12 hours of curing after the primer coat embedded, the air temperature is 10° C.

Objects of the test: the first bonding force (the bonding force between the wall and the bottom tectorial membrane) and the second bonding force (the bonding force between the outer layer and the inside layer).

The gel content is calculated according to the glue spread of the non-setting adhesive

| The gel content g/m$^2$ | Whether the transportation is septated from the storage or not | Whether it is separated in in-field use (when coating the topcoat) | Recording of the non-setting adhesive demoulded |
|---|---|---|---|
| 100 | no | yes | — |
| 150 | no | yes | — |
| 200 | no | yes | — |
| 250 | no | no | It is smooth to demould the topcoat, without taking the primer coat out |
| 300 | no | no | It is smooth to demould the topcoat, without taking the primer coat out |

-continued

| The gel content g/m$^2$ | Whether the transportation is septated from the storage or not | Whether it is separated in in-field use (when coating the topcoat) | Recording of the non-setting adhesive demoulded |
|---|---|---|---|
| 350 | no | no | It is smooth to demould the topcoat, without taking the primer coat out |
| 400 | no | no | It is smooth to demould the topcoat, without taking the primer coat out |
| 450 | no | no | It is smooth to demould the topcoat, without taking the primer coat out |
| 500 | no | no | It is smooth to demould the topcoat, without taking the primer coat out |
| 550 | no | no | It is smooth to demould the topcoat, without taking the primer coat out |
| 600 | no | no | It is smooth to demould the topcoat, without taking the primer coat out |
| 650 | no | no | the primer coat was taken out when demoulding the topcoat |
| 700 | no | no | the primer coat was taken out when demoulding the topcoat |
| 750 | no | no | the primer coat was taken out when demoulding the topcoat |
| 800 | no | no | the primer coat was taken out when demoulding the topcoat |

Conclusion: when the gel content is of from 250 g/m$^2$ to 600 g/m$^2$, the mould is in normal and can be demoulded twice.

1.3 Cross Reference

Produce wall tiles by the method similar to that in the ejection from the mould experiment 1.1, the difference is in that the mould for the in-situ production of wall tiles is demoulded once, and with the intermediate-coat omitted. That is embed the mould once before the initial set of the primer coat, and then ejection from the mould, coating the topcoat.

Making the appearance test with reference to allowed band (GB/T4100-92) of the presentation quality of the glazed interior wall tile. The test results are as follows:

| | Result of the appearance test | 10 min | 20 min | 30 min |
|---|---|---|---|---|
| Example for reference | Edge chipping | 10% | 15% | 20% |
| | flashing | 80% | 80% | 80% |

The inventors found that, the primer coat and the mould demoulded once would be flattened when embedding the mould demoulded once before the initial set of the primer coat, that is, all the mould demoulded once would be embedded into the primer coat. The compound body of the primer coat and the mould demoulded once, for example, coating the topcoat, because the topcoat without ingredient of aggregate is very thin, about 0.1 mm, therefore the color of the prime coat which equals to the thickness of the decorative wall tile mould (about 0.5 mm) is left on the lateral of the formed body after ejection from the mould. And more thicker the mould, more thicker the color lump on the lateral of the formed body. That will seriously affect the overall decorating effect; if the topcoat without ingredient of aggregate is used, it needs the spray finishing and the trowelling processes to coat, the non-uniform in the junction and the texture of the finish coat will cause the color shift in the finishing coat; for example, when coating a finishing coat with aggregate on the dry topcoat, though the color shift is decreased, because the mould demoulded once has not been demoulded, the topcoat with aggregate will have flashing and edge chipping phenomenon due to the ejection from the mould and the shearing effect during the ejection from the mould with the dry aggregate topcoat, which makes the formed body not intact and regular.

With reference to allowed band (GB/T4100-92) of the presentation quality of the glazed interior tile, the wall tile produced by the mould demoulded once is in disqualification, which needs to be treated once more, thus increases the man-hour.

All documents mentioned in the present invention are for reference in the application, just as each document referenced single. In addition, it is appreciated that the skilled person in the art will make a variety of changes and modifications to the present invention, of which all the equivalent form will fall into the scope of the claims appended.

What is claimed is:

1. A method for applying decorative wall tile in in-situ production on an associated building, comprising the steps of:

coating a surface of the building with a primer coat;

embedding a dedicated slabby decorative wall tile mould into the primer coat, the mould having apertures or openings formed therein, the mould having an inner layer having a bottom film and an outer layer having a surface film, the mould further including an adhesive between the inner and outer layers, the mould being embedded into the primer coat when the primer coat has retained plasticity, to establish a first compound body;

coating the first compound body after curing with an intermediate-coat;

separating the outer layer of the mould from the inner layer of the mould and stripping the inner layer of the mould and a portion of the first compound body and a portion of the intermediate coat not overlying the apertures or openings to establish a second compound body, the inner layer, portion of the first compound body and portion of the intermediate layer being stripped when the intermediate coat has retained plasticity;

coating the second compound body, exposed primer coat after curing and the remaining mould inner layer with a topcoat;

and stripping the inner layer to produce the decorative wall tile in-situ.

2. The method of claim 1, wherein the primer coat or the intermediate coat is made from a material selected from the group consisting of gel materials, packing materials, pigment, additives and aggregate, wherein the gel material is an inorganic gel material, organic gel material or a combination thereof, and wherein the topcoat is made from a material selected from the group consisting of gel material, packing material, pigment, additives and aggregate, and wherein the gel material is an inorganic gel material, an organic gel material or a combination thereof.

3. The method of claim 1, wherein a thickness of the mould is about 0.3 mm to 3 mm.

4. The method of claim 1, wherein the wherein the adhesive is applied at a weight of about of 250 to 300 g/m$^2$.

5. The method of claim 1, wherein the mould includes a bottom film positioned at a bottom surface thereof, the bottom film and the building have a first combinative force, a surface film disposed on a surface of the bottom film, the bottom film and surface film adhered to one another by an adhesive between bottom film and the surface film, the adhesive exhibiting a second combinative force that is less than the first combinative force.

6. The method of claim 1 wherein the insider layer is a double tectorial membrane sheet.

* * * * *